United States Patent [19]

Centis

[11] 4,379,392

[45] Apr. 12, 1983

[54] APPARATUS FOR STEAMING PRINTED FABRICS

[75] Inventor: Sergio Centis, Gerenzano, Italy

[73] Assignee: Arioli & C.S.r.l., Gerenzano, Italy

[21] Appl. No.: 190,213

[22] Filed: Sep. 24, 1980

[30] Foreign Application Priority Data

Oct. 1, 1979 [IT] Italy ..... 26160 A/79

[51] Int. Cl.[3] ..... D06B 3/30

[52] U.S. Cl. ..... 68/5 C; 34/157; 34/225

[58] Field of Search ..... 68/5 C, 5 D, 5 E; 34/155, 157, 159, 224, 225, 232, 233

[56] References Cited

U.S. PATENT DOCUMENTS

| | | | |
|---|---|---|---|
| 1,952,825 | 3/1934 | Sibson et al. | 68/5 D |
| 2,152,238 | 3/1939 | Bridges | 34/159 |
| 3,225,455 | 12/1965 | Waddelle | 34/225 X |
| 3,901,053 | 8/1975 | Meisen et al. | 68/5 D |
| 3,967,473 | 7/1976 | Arioli et al. | 68/5 D |

FOREIGN PATENT DOCUMENTS

| | | | |
|---|---|---|---|
| 2414708 | 10/1975 | Fed. Rep. of Germany | 68/5 C |
| 2005319 | 4/1979 | United Kingdom | 68/5 D |

*Primary Examiner*—Philip R. Coe
*Attorney, Agent, or Firm*—Bucknam and Archer

[57] ABSTRACT

An improved apparatus for carrying out steaming or similar operations in a double-wall chamber opened at the bottom with steam passing from the bottom to the top through gaps. The apparatus, comprises operating assemblies including fans and radiators effective to cause the air treating means to circulate at intermediate levels with respect to the height of the chamber, and steam and water and power supplying means capable of being selectively operated to allow the apparatus to operate by different air treating means or media.

11 Claims, 2 Drawing Figures

E
60
64
62
66
H2O
54
56
48
44
46
50
80
V
12
24
42
30
58
40
38
22
52
10
18
32
34
36
72
74
14
16
28
F'
F''
70
68

APPARATUS FOR STEAMING PRINTED FABRICS

BACKGROUND OF THE INVENTION

The present invention relates to an improved apparatus, for carrying out treating operations on printed fabrics, which operations are frequently called "steaming" operations though improperly since they can be carried out without using steam but, for example, hot air, the improved apparatus being effective to operate, depending on the requirements, by using saturated steam or superheated steam or alternatively, hot air.

More specifically the apparatus according to the invention is of the type in which the static structure enclosing the treating environment, through which the fabric as suitably supported in laps, is conveyed, provided with a double wall and, in the gap of the double wall, with a passage through which, in the case of a high temperature treating or a saturated steam treating, the air fluid forming the treating medium or means is caused to pass from the bottom to the top so as to reach the top of the saddle roof of the structure, to descend progressively so as as to reach the base portion of the treating envoronment, the latter being at least partially opened to the outside.

Apparatus provided with the thereinabove cited structural and operational characteristics are well known in the art: (see for instance Italian patent application No. 28335 A/77 and the corresponding U.S. Pat. No. 4,186,572 which issued Feb. 5, 1980. In this issued Patent it is provided that at least a portion of the circulating air treating means or medium circulates between intermediate levels with respect to the treating environment height, the circulation being promoted and held by entraining jets of the treating means or medium, which is supplied under pressure.

SUMMARY OF THE INVENTION

The improved apparatus according to the present invention comprises, in a treating environment formed by a treating structure essentially of the type disclosed and illustrated in the same U.S. patent application mentioned hereinabove, at least an operating assembly, preferably a plurality of operating assemblies, which are preferably located in at least a portion of the vertical walls of the static structure enclosing the treating environment, the operating or operative assembly/assemblies or at least a portion of the operating assemblies comprising mechanical means, such as a fan, capable of imparting the required movement to the circulating air treating medium or fluid, and at least a heat generating or exchanging means located at a portion traversed by the circulating treating air fluid, in the interior of the operating assembly, the improved apparatus further comprising fittings, ducts and similar means for supplying the components of the operating assembly or plurality of operating assemblies.

Practically, the apparatus can be selectively operated by using different treating media and operating conditions, and by acting upon the different supplying means, i.e. in such a way as to put the supply means in an operative or inoperative position.

More specifically, to carry out treating operations by using saturated steam, the lower portion of the structure gap or interspace (that is the portion where is set, or held, in a known way, a predetermined water level is connected to a steam source, in general a boiler provided in the system, while the lower portion of the operating assembly or assemblies is connected to a water source in order to carry out the moistening of the air medium circulating through the assembly or assemblies, while the heat generating or exchanging means are maintained in an operating condition.

Alternatively, in order to carry out high temperature treatments, the heat generating or exchanging means are actuated and there is maintained the supply of steam at the base of the gap or interspace, while the moistening water supplying is stopped.

Finally, in order to carry out a treatment of the so-called hot or heated air type, all the supplies of steam and water are stopped, while the means for bringing heat to the circulating air, are maintained in an operating condition, under the control of the mechanical pushing means, (practically, as stated hereinabove, at least a fan).

From a structural or constructional point of view, the operating assembly or assemblies are materially recessed in recesses formed in the thickness of the gap provided between the vertical walls, the bottom vertical wall of the recesses, which wall being outwardly directed, is formed by portions of the double-wall static structure of the apparatus.

These recesses are separated one from another by spaces defining the gap, in such a way as to assure the continuity of the passage between the base of the walls and the portion, of the double wall type, of the essentially known static structure.

BRIEF DESCRIPTION OF THE DRAWINGS

The aforesaid and other more specific characteristics and advantages of the present invention and possibilities afforded by an industrial application thereof, will become more apparent from the following detailed description of a non limitative exemplary embodiment of the improved apparatus, with reference to the accompanying drawings, where.

DESCRIPTION OF THE PREFERRED EMBODIMENTS

Figure 1:
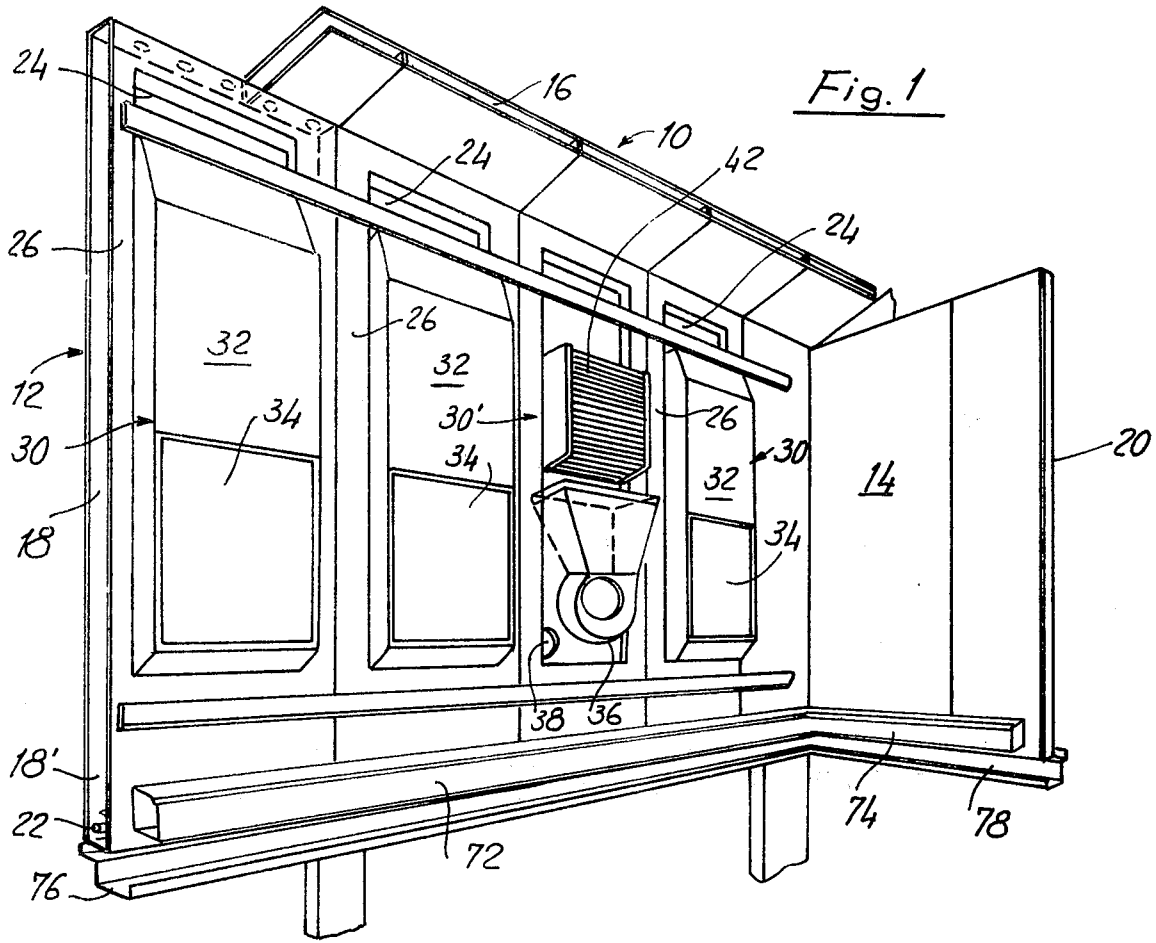
FIG. 1 is a perspective fragmentary view illustrating a portion of the apparatus, as seen from the interior, the cover of one of its operating assemblies or sets being removed in order to show the related main components.

Referring specifically to the figures of the drawings, the static structure of the treating environment, as fragmentarily represented in FIG. 1, comprises a chamber provided with a saddle roof 10 and defined by side walls, 12 and front wall 14 respectively, of the double-wall type, and forming gaps or interspaces 16 and respectively 18 and 20.

In the lower portions 18' of the gap 18 are located perforated ducts 22 in which, under some treating conditions, is introduced steam which mainly arrives from the system boiler or from the overall plant, and the steam exiting the ducts 22 bubbles through water provided at suitable level at the base of said gap, as described in the patent cited hereinabove.

The double walled structures, in particular of the vertical longitudinal walls 12, are interrupted to provide recesses or cavities 24; however between the recesses are formed portions 26 (FIG. 1) along the gap in uninterrupted or continuous manner from the base 18' as far as its connection with the gap 16, in the interior of the roof 10. At the top or near the top of the roof, the gap 16 is provided with ports or openings 28 (FIG. 2) through which the steam descends into the treating chamber.

The operating assemblies or sets which are characteristic of the improved apparatus, as indicated overally at 30, are located in the recesses 24 and protected by covers 32 (a cover is removed in FIG. 1 at the assembly 30') which covers are perforated at the lower portions 34, or capable of being unobstructedly traversed by the air medium or means present in said treating environment and which is sucked by suitable fans as provided in the respective operating assemblies 30.

At the base of the assemblies new or fresh air can be sucked from the exterior, through suitable valves 38. At 40 is indicated the driving or actuating system for actuating the respective fan 36.

The operating components of each operating assembly comprise a radiator system 42 for applying thermal energy or power to the air fluid circulating through the assembly. The radiator or radiating system 42 may comprise a coil through which a fluid having the required temperature can circulate, for example high pressure steam, diathermal oil or other liquid capable of providing the required temperature. As electric power is used for heating, the system 42 may comprise electric resistances.

Figure 2:
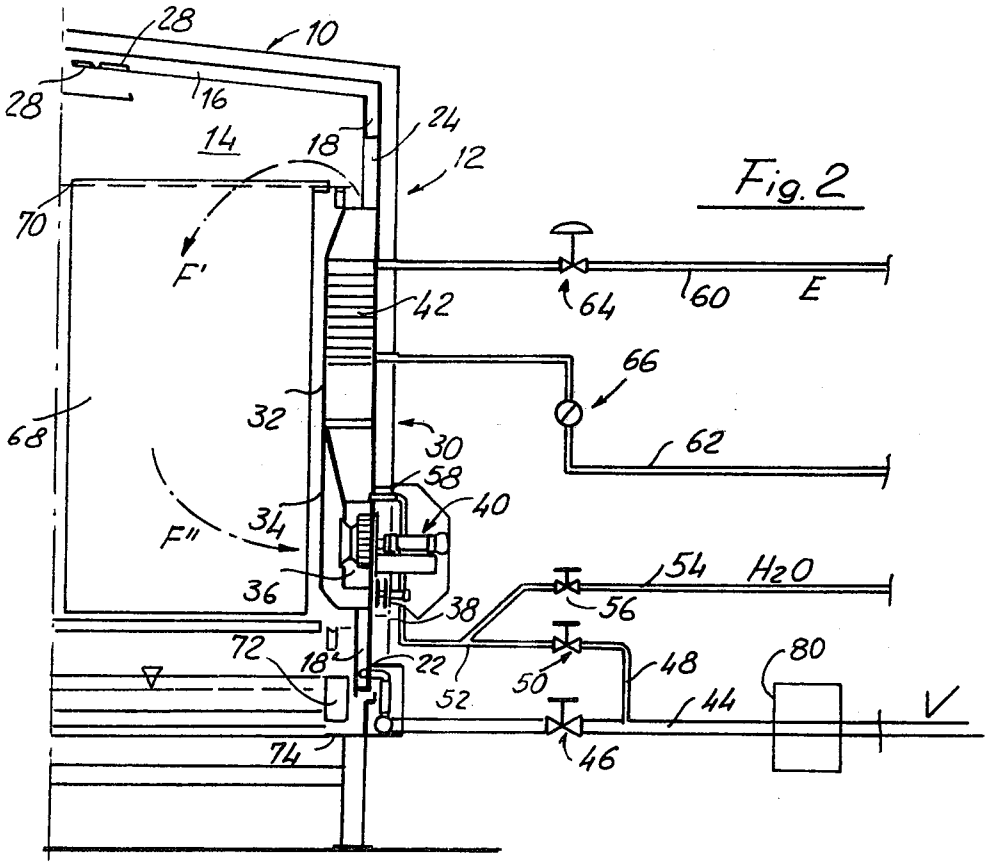
FIG. 2 is a half cross-section of the apparatus as taken through a vertical cross plane containing one of said operating assemblies, as associated to the different supply ducts, the latter being represented schematically and including, preferably, fittings and branches for reaching the individual operating assemblies.

Each operating assembly or set is connected, preferably through fittings and manifolds, to supply systems and circuits, as it is schematically illustrated in FIG. 2.

The supply or supplying means comprise at least a duct 44 for supplying the steam V, through a sliding or interception and adjusting valve 46, to the perforated duct 22 which provided at the base 18' of the gap 18. The duct 44 comprises a branch 48, also provided with sliding and adjusting valves 50, which connects at 52 with a duct 54, provided with a related sliding and adjusting valve 56, for supplying water ($H_2O$) for moistening the air fluid circulating through the assembly which is sprayed at 58, preferably at the outlet of the fan 36.

At 60 and 62 are represented, exemplary, ducts provided with valve means 64 and 66, as components for delivering and returning in the energy supplying circuit E, supplying the radiator 42, the means consisting obviously of ducts, in the case in which the radiator 42 is an exchanger unit supplied in a closed loop with a high temperature fluid or liquid, and respectively of electric wires, in the case in which the radiator 42 comprises electric resistances.

During the service period, it is obviously assumed that in the treating chamber there is present the printed fabric to be treated, as supported in laps, one whereof being indicated at 68 in FIG. 2, the laps being supported and caused to advance by cross rods 70, as it is well known in the art.

Practically the apparatus provides the means for establishing and maintain, jointly or alternatively, two circuits or loops of the air treating medium, in the interior of the environment which, communicating freely at the base with the outside, is always at atmospheric pressure.

One circuit extends in known way, in particular as described in the patent cited hereinabove, and is supplied with steam V sent at the base 18' of the gaps or interspaces 18 and 16 and introduced from the top, at 28, of the treating chamber. This steam, as it reaches its possible lower level L, is sucked, also in known way, through ducts 72 and 74 at the base of the vertical walls 12 and 14 of the treating chamber, preferably overlying channels 76 and respectively 78 (FIG. 1) for collecting the condensate descending on the inner surfaces of said walls. Accordingly this circuit is not herein described further.

The other circuit which, under some alternative conditions (or selective conditions) may exists jointly with the first one, closes in the interior of the treating chamber between intermediate levels with respect to the useful height, and, more specifically, between the top of the operating assemblies and the perforated portions 34 of the respective covers 32, the path of this latter circuit, in the treating environment being schematically indicated by the arrows F' and F'' in FIG. 2.

As stated hereinabove the improved apparatus is effective, with respect to its constructional characteristics and operating means, to selectively operate according to different operating methods, as required by an industrial application, and, more specifically:

if it is desired to operate in a saturated steam environment, by operating the valve 46 steam is sent to the base 18' of the gap, in such a way as to produce saturated steam at the output of the present water and into it are immersed the ducts 22, through which saturated steam rises along the gaps and discharges from the top to the bottom at 28 at the top of the chamber.

Simultaneously the fans 36 are actuated as well as the moistening circuit 48 and 54 in such a way as to establish in the interior of the environment a recirculation F' and F'' of moistened steam. This circulation is not however drastically critical and it can be omitted, if desired.

if it is desired to operate under high temperature conditions, to the circuit described hereinabove, which circuit closes through the gaps 18 and 16, is associated, between the top and the base (level L) of the treating environment, the circuit F', F'' by actuating the radiators 42 for supplying energy.

finally, if it is desired to operate in heated or hot air, the supply of steam V and water $H_2O$ from the ducts 44 and 54 is stopped, while maintaining the fans 36 and radiators 42, in operation the circulation of the heated air, as heated by the radiators, closing at F' and F'' through the operating assemblies, the possible air excess due to the introduction of fresh air at 38, discharging even in this case from the base of the chamber.

Since the structures, means and methods which are characteristic of the present invention have been described hereinabove and illustrated merely as indicative not limitative example, it should be noted that they are susceptible to many modifications and variations depending on the specific applications and service and production exigences of the apparatus.

For example, in order to increase the temperature of the steam V introduced into the apparatus, the steam can be superheated by means of superheaters 80 located and operating upstream of the duct 44. Furthermore, the temperature of the steam descending at 28 from the top of the chamber can be increased by means of radiators, such as heting coils supplied with high temperature steam, diathermal oil or the like, as well as electric resistances, located in the gaps or interspaces extending from the bottom to the top through the walls of the apparatus, the thermal energy supplying means being in turn effective to be actuated and to be put out of operation for selectively carrying out one method or the other, as well as variations.

For these reasons it should be noted that the variations indicated hereinabove as well as other possible variations and modifications are to be considered as falling within the scope of the invention as defined by the accompanying claims.

What is claimed is:

1. In an apparatus for treating printed fabrics in which air is circulated and at least a portion of the circulating air circulates between intermediate levels with respect to the height of the treating chamber, the improvement which comprises a double wall static structure, constituting the treating environment, said structure defining in the interior thereof a chamber opened at the bottom, having a saddle roof (10), double vertical side walls (12) and double vertical front wall (14), gaps formed by said double walls (16, 18, 20), perforated ducts (22) for emitting steam into a water pool at the base of said gaps in the vertical side walls and vertical front walls to the top of said chamber under said saddle roof, ports (28) in said saddle roof for introducing said steam from the top to the bottom into said treating environment, at least one operating assembly located in at least a portion of the side walls of the static structure, means for introducing air at the base of said operating assembly, said operating assembly including mechanical means effective to cause the air to circulate through a circuit looped through said operating assembly, said assembly including radiator means (42) for applying thermal energy to the air circulating through said circuit, and a supply system adapted to supply selectively liquid and/or gaseous substances and power means effective to supply said radiator means with thermal energy, said supply system being effective to be put in an operative or inoperative position to selectively set said apparatus to operate, by saturated steam or superheated steam, or by hot air.

2. The apparatus according to claim 1, wherein said mechanical means comprises a fan providing said means effective to circulate said air.

3. The apparatus according to claim 2, wherein said operating assemblies comprise means for introducing water at the outlet of said fan, for moistening the circulating air, said means being effective to be selectively put in an operative or inoperative position.

4. The apparatus according to claim 3, wherein a plurality of fans is provided and each fan is provided with an outlet, and said means for introducing the water are located to spray said water substantially at the outlet of the respective fan.

5. The apparatus according to claim 3, wherein said supply means comprise a duct for supplying with water said moistening means.

6. The apparatus according to claim 1, wherein said operating assembly is protected by an envelope (32), the operating assembly includes operating members which communicate with the interior of said chamber in order to set said circuit between intermediate levels with respect to the useful height of said chamber.

7. The apparatus according to claim 1, wherein a plurality of operating assemblies are installed, at least partially, between the interior of said chamber, and at the vertical walls thereof.

8. The apparatus according to claim 7, wherein said vertical walls are interrupted to provide recesses and said operating assemblies are mounted in said recesses (24), said recesses being spaced from one another by portions of said vertical walls by means of which a portion of said vertical walls is effective to maintain the continuity of the communication between the base of the walls and the top thereof.

9. The apparatus according to claim 1, wherein said supply means for supplying said operating assembly comprise at least a duct for supplying with steam the perforated ducts at the base of said gaps and means for supplying energy or thermal energy supplying fluids to said radiator means.

10. The apparatus according to claim 1, wherein said supply means each comprises sliding and/or selective adjusting valve systems.

11. The apparatus according to claim 1, which comprises heat exchangers or radiators in said gaps in the static structure defining said chamber, to bring additional heat to the steam passing from the bottom to the top through said gaps.

* * * * *